US005950889A

United States Patent [19]

Feldman, Jr.

[11] Patent Number: 5,950,889

[45] Date of Patent: Sep. 14, 1999

[54] HIP BELT APPARATUS AND SYSTEM FOR CARRYING A GOLF BAG

[76] Inventor: Karl Thomas Feldman, Jr., 1704 Stanford Dr., NE Albuquerque, N.Mex. 87106

[21] Appl. No.: 08/927,449

[22] Filed: Sep. 11, 1997

[51] Int. Cl.[6] ..... A45F 3/04; A63B 55/00

[52] U.S. Cl. ..... 224/259; 224/250; 224/625; 224/645; 206/315.3

[58] Field of Search ..... 224/645, 250, 224/259, 262, 651, 625, 626; 206/315.3

[56] References Cited

U.S. PATENT DOCUMENTS

| | | | |
|---|---|---|---|
| 4,079,871 | 3/1978 | Sica . | |
| 4,140,253 | 2/1979 | Vickers et al. . | |
| 4,182,470 | 1/1980 | Atkinson | 224/183 |
| 4,433,803 | 2/1984 | Liberboim | 224/251 |
| 4,709,693 | 12/1987 | Key | 224/250 |
| 4,715,839 | 12/1987 | Ford et al. | 446/28 |
| 4,747,527 | 5/1988 | Trumpower, II . | |
| 4,982,883 | 1/1991 | Ullal et al. . | |
| 5,038,984 | 8/1991 | Izzo . | |
| 5,042,702 | 8/1991 | Douglass . | |
| 5,042,703 | 8/1991 | Izzo . | |
| 5,042,704 | 8/1991 | Izzo . | |
| 5,064,108 | 11/1991 | Headley | 224/259 |
| 5,205,448 | 4/1993 | Kester et al. | 224/240 |
| 5,419,473 | 5/1995 | Lamar . | |

*Primary Examiner*—Linda J. Sholl
*Attorney, Agent, or Firm*—Richard A. Bachand

[57] ABSTRACT

An apparatus and system for carrying a weight-bearing object, such as a golf bag, has a hip belt member for supporting the weight-bearing object and reducing the load on the user's back and shoulders. An attachment member is coupled to the hip belt member for attaching the hip belt member to the weight-bearing object, and a belt fastener connects the hip belt member about the user's waist. Additional shoulder straps can be utilized to stabilize and reduce movement of the weight-bearing object about the user.

14 Claims, 7 Drawing Sheets

HIP BELT APPARATUS AND SYSTEM FOR CARRYING A GOLF BAG

BACKGROUND OF THE INVENTION

1. Field of the Invention

This invention relates in general to sport and utility bags, and in particular to golf bags having various straps for reducing the stress placed on a user's shoulders and back.

2. Background

Golf bags are traditionally used by golfers to carry golf clubs, golf accessories such as golf balls, golf tees, umbrellas, raincoats, golf towels, as well as food and beverage items, among other things. A fully-loaded golf bag can weigh between 20 to 40 lbs. Hence, carrying a golf bag can be physically demanding to the golfer while golfing.

Conventional golf bags have a shoulder strap attached to the central portion and top opened portion of the golf bag. This shoulder strap permits the golfer to carry the golf bag over one shoulder, which tends to concentrate the weight of the bag on the golfer's shoulders and back. Depending on the weight of the bag, carrying a golf bag with a conventional shoulder strap can be uncomfortable and create muscle aches and soreness in the golfer's shoulder and back.

U.S. Pat. No. 5,038,984 teaches a dual strap carrying system for a golf bag which provides two shoulder straps to distribute the weight of the bag onto both shoulders. The golf bag is provided with a back cushion or pillow which conforms to the lower back of the golfer.

U.S. Pat. No. 5,042,702 teaches a belt member having a velcro fastening system which mates with a corresponding piece of velcro attached to a golf bag. The belt member is intended to be worn at all times during play. One of the drawbacks which exist with this belt member is that it is designed to be worn throughout the golfing activity, which could adversely affect the golfer's normal swing or putting stance during play.

U.S. Pat. No. 5,419,473 teaches a golf bag with lumbar support and a waistband which is designed to attach to the lower portion of the golf bag. The golf bag is carried vertically along the golfer's back centered between the golfer's shoulders. A lumbar pad is provided to distribute the weight of the bag to the user's lower back. One drawback of this system is that the bag is vertically oriented, which inhibits the golfer's ability to easily remove or insert golf clubs into the golf bag, or access other items stored in the golf bag. A golfer may also be inhibited from easily bending forward to, for example, pick up a golf ball, drink from a drinking fountain, or tie shoelaces.

What is needed is an apparatus and system for carrying a golf bag which reduces most of the load on the golfer's shoulders and back by transferring the weight of the load to the hips and legs, while maintaining an orientation of the golf bag which permits easy access to the items stored therein. The apparatus and system should also permit the golfer to easily remove the bag and its associated components so that the golfer can enjoy a natural golf swing unencumbered by the golf bag carrying apparatus.

It is with the shortcomings of the existing art in mind that the significant improvements and advancements of present invention were developed.

SUMMARY OF THE INVENTION

The above problems have been solved by the hip belt apparatus and system of the present invention. According to one broad aspect of the invention, an apparatus for carrying a weight-bearing object, such as a golf bag, is presented and includes a hip belt member, a belt fastener, and an attachment member. The hip belt member is provided for supporting the weight-bearing object about a user's hips, and has a first end and a second end. The belt fastener removably connects the first end of the hip belt member to the second end of the hip belt member about the user's waist. The attachment member is coupled to the hip belt member for attaching the hip belt member to the weight-bearing object. In one embodiment of the invention, the attachment member comprises a first attachment member for coupling the hip belt to the weight-bearing object about a first attachment point, and a second attachment member for coupling the hip belt member to the weight-bearing object about a second attachment point. The center of gravity of the weight-bearing object is positioned between the first and second attachment points.

According to another broad aspect of the invention, an apparatus for carrying a weight-bearing object, such as a golf bag, is presented and includes a hip belt member for supporting the weight-bearing object about a user's hips. The hip belt member has a central portion, a first hip portion, and a second hip portion. A first waist strap is coupled to the first hip portion, and a second waist strap is coupled to the second hip portion. A belt fastener connects the first waist strap to the second waist strap about a user's waist, and an attachment member is coupled to the hip belt member for attaching the hip belt member to the weight-bearing object.

The hip belt member can be padded along the central portion, as well as the first and second hip portions, to improve the user's comfort. The first and second waist straps can be adjustable in length so that the hip belt member can be used by people having different waist sizes. The belt fastener can be a bayonet-type snap clasp having a male end and a female end for simple attachment and removal of the hip belt member about the user's hips.

The attachment member can comprise a first attachment member having an adjustable fastener and a second attachment member having an adjustable fastener. The first attachment member can be attached to the hip belt member at a first attachment point on the central portion or the hip portion of the hip belt, and the second attachment member can be attached to the hip belt member at a second attachment point on the central portion or the hip portion of the hip belt.

According to another broad aspect of the invention, a system for carrying a weight-bearing object, such as a golf bag, is presented including a hip belt member, a belt fastener, an attachment member, and a shoulder strap. The hip belt member is provided for supporting the weight-bearing object, and the belt fastener connects the first end of the hip belt member to the second end of the hip belt member about a user's waist. The attachment member is coupled to the hip belt member for attaching the hip belt member to the weight-bearing object, and the shoulder strap is provided for stabilizing the weight-bearing object about the user, the shoulder strap having one end coupled to the weight-bearing object.

The attachment member can include a first attachment member for coupling the hip belt member to a top portion of the weight-bearing object about a first attachment point, and a second attachment member for coupling the hip belt member to a central portion of the weight-bearing object about a second attachment point. The shoulder strap can include a first and second shoulder strap. The first shoulder strap has a central portion, a first strap for attachment to the first attachment point, and a second strap member for attachment to the second attachment point. The second shoulder strap can have a central portion, a first strap for attachment to the weight-bearing object at a point along the top of the weight-bearing object, and a second strap member for attachment to the second attachment point. In this manner, the golf bag will be oriented substantially horizontal so that its contents are readily accessible by the user.

Further, the first shoulder strap can be provided with a slot member positioned along the first strap for defining a slot adapted to receive the first strap of the second shoulder strap to prevent tangling of the shoulder straps.

The great utility of the present invention is that the load of the golf bag on the golfer's shoulders and back is reduced by transferring a portion of the load to the golfer's hips and legs, while maintaining an orientation of the golf bag which permits easy access to the items stored therein. The golf bag is easily removable so that the golfer can enjoy a natural golf swing unencumbered by the golf bag carrying apparatus.

The foregoing and other features, utilities and advantages of the invention will be apparent from the following more particular description of a preferred embodiment of the invention as illustrated in the accompanying drawings.

DETAILED DESCRIPTION OF THE PREFERRED EMBODIMENT

In accordance with the present invention, a hip belt apparatus and system are presented for carrying a weight-bearing object such as a golf bag. The present invention transfers a substantial portion of the load of the weight-bearing object along the hips of a person through a hip belt member attached to the weight-bearing object. By transferring the weight to the person's hips, the load on the person's back and shoulders is reduced for improved comfort. The hip belt member is adapted to fit snugly about a person's waist and upper portion of their hips to effectively support the weight-bearing object. An optional shoulder strap system can be used in conjunction with the hip belt member to improve the stability of the system.

Figure 1:
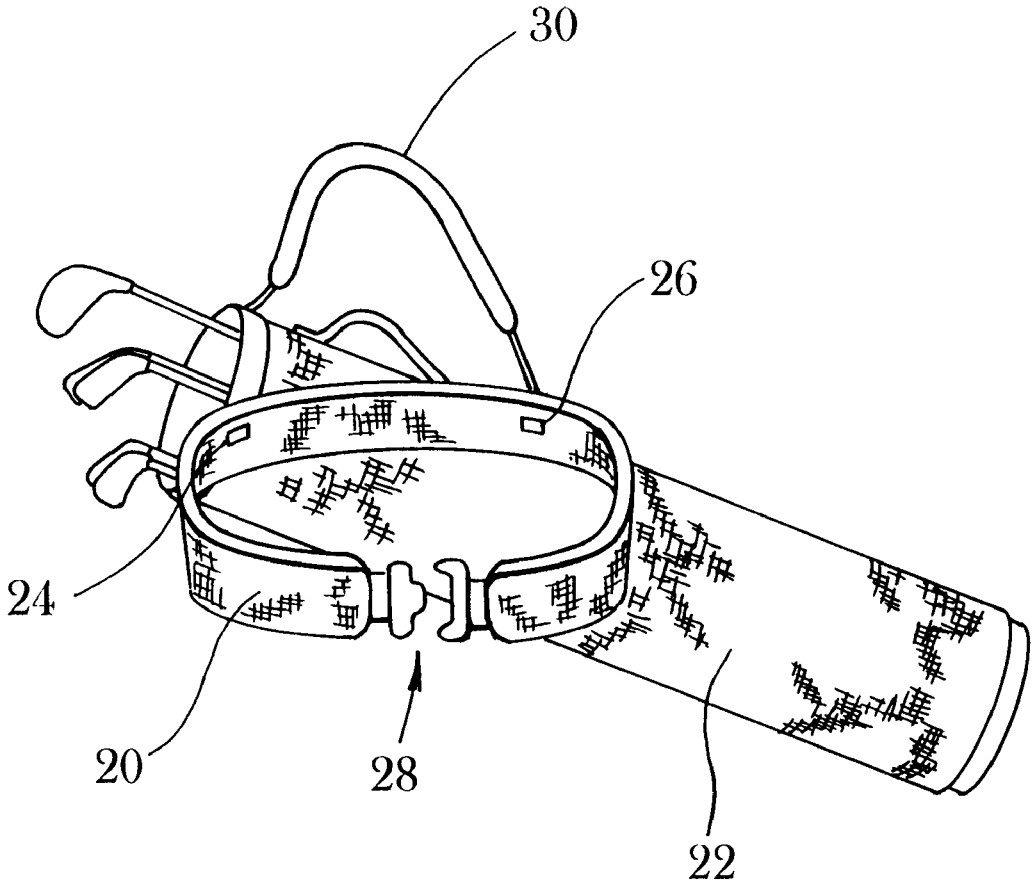
FIG. 1 illustrates an isometric view of the hip belt member of the present invention attached to a golf bag.

FIG. 1 shows a hip belt member 20 attached to a weight-bearing object 22, such as a golf bag. The hip belt member 20 has a first and second point of attachment 24, 26 to the weight-bearing object, thereby distributing the load of the weight-bearing object to the first attachment point 24 and the second attachment point 26 of the hip belt member. The first and second attachment points are respectively coupled to a first and second attachment members, shown in FIG. 2.

The first and second attachment points 24, 26 are ideally attached to at least two points on the weight-bearing object 22 so that the weight-bearing object is properly oriented and its center of gravity resides between the first and second attachment points. In this manner, the load of the weight-bearing object is positioned between the first and second attachment points and distributed therebetween onto the hips and legs of the user.

The hip belt member 20 has a belt fastener 28 to secure the ends of the hip belt member together about the waist and hips of the user. In one example, the belt fastener 28 has adjustable ends so that the hip belt member can be snugly positioned about the user's waist.

Figure 4:
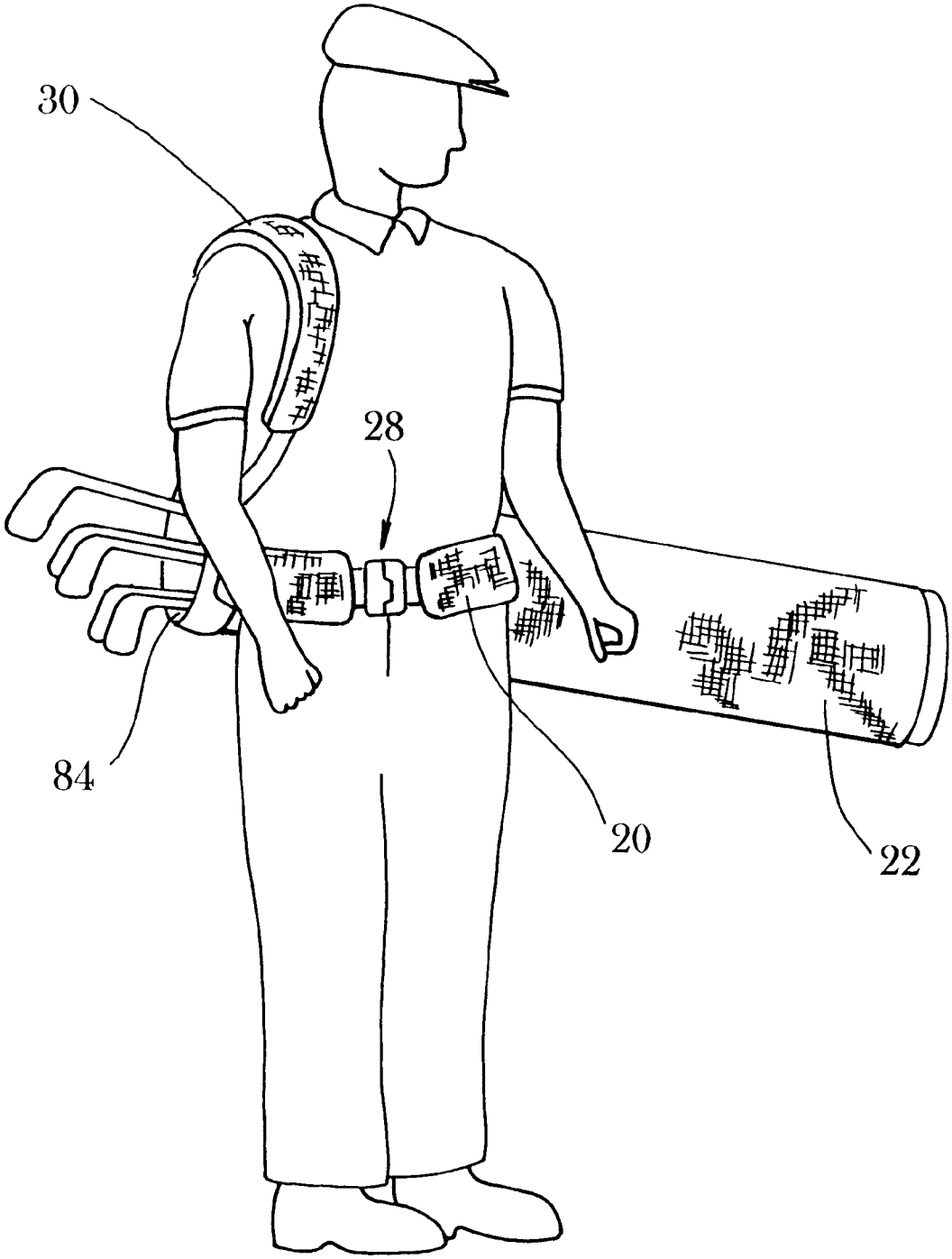
FIG. 4 illustrates a golfer utilizing the hip belt member of the present invention to carry a golf bag.

FIG. 1 shows the weight-bearing object 22 as a golf bag having a conventional shoulder strap 30. In accordance with the present invention, the hip belt member 20 can be attached to the golf bag and used in conjunction with the conventional shoulder strap, as shown in FIGS. 1 and 4.

Figure 2:
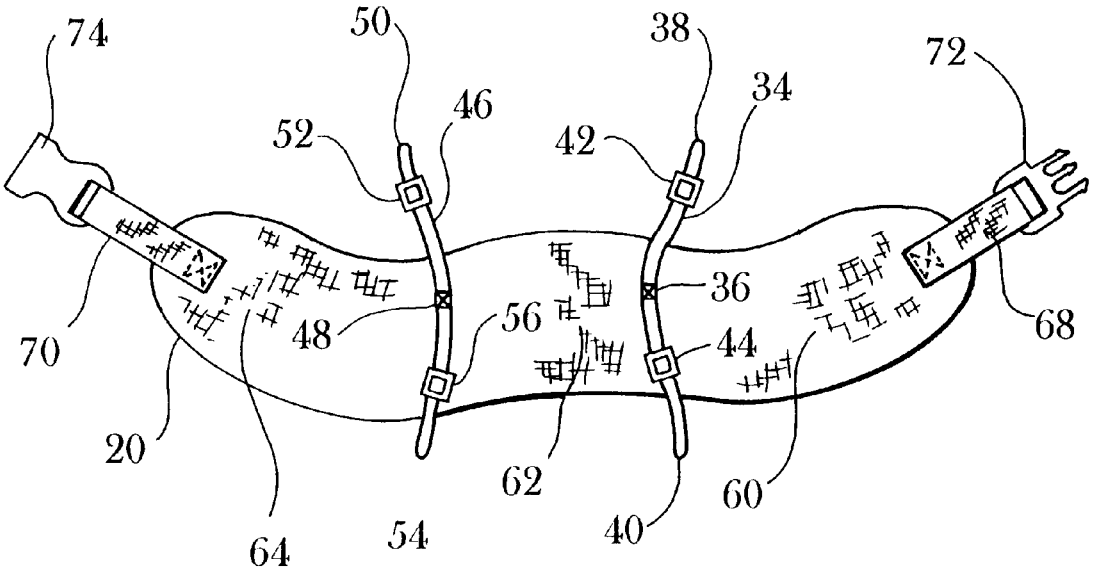
FIG. 2 illustrates a rear elevation view of the hip belt member in accordance with the present invention.

FIG. 2 illustrates a rear view of the hip belt member 20 of FIG. 1. A first attachment member 34 is attached to the hip belt member 20 at a first attachment point 36 using a sew attachment or other like attachment method. The first attachment member 34 has a first end 38 and a second end 40 for attachment to the weight-bearing object. The first end 38 has a first adjustable fastener 42 which can receive either the first end 38 in a loop configuration, or the second end 40 inserted through the first adjustable fastener 42. Likewise, the second end 40 of the first attachment member 34 has a second adjustable fastener 44 for receiving either the second end 40 in a loop configuration or the first end 38 therethrough. Likewise, a second attachment member 46 secured to the hip belt member through a sew attachment or like attachment method at a second attachment point 48, has a first end 50 with a first adjustable fastener 52, and a second end 54 with a second adjustable fastener 56.

The hip belt member has a first hip portion 60, a central portion 62, and a second hip portion 64. The first and second hip portions are adapted to be positioned about the user's hip (i.e. the lateral parts of the pelvis) to transfer the weight of the weight-bearing object to the hips and the legs of the user. The central portion 62 of the hip belt member couples the first hip portion 60 to the second hip portion 64 and provides a location for the securement of the first and second attachment members 34, 36 to the hip belt member. Alternatively, the first and second attachment members 34, 46 could be attached to the first and second hip portions 60, 64 to secure the weight-bearing object thereto.

The hip belt member also has a first waist strap 68 attached to the first hip portion and a second waist strap 70 attached to the second hip portion which secure adjustable male and female ends 72, 74 of the belt fastener. A sew attachment or other like method can be used to the connect the first and second waist straps 68, 70 to their respective first and second hip portions 60, 64 of the hip belt member 20. The belt fastener, in one embodiment of the invention, is a bayonet-type, side-release snap clasp having an adjustable female end 74 adapted to removably yet secureably receive an adjustable male end 72. Both the female end and male end are adjustable along their respective waist straps 68, 70 so that the hip belt member can be used by persons having different waist sizes. Different lengths of the hip belt member can also be manufactured to accommodate for different waist sizes within the adjustable dimensions provided by the waist straps 68, 70 with adjustable ends 72, 74.

Figure 3:
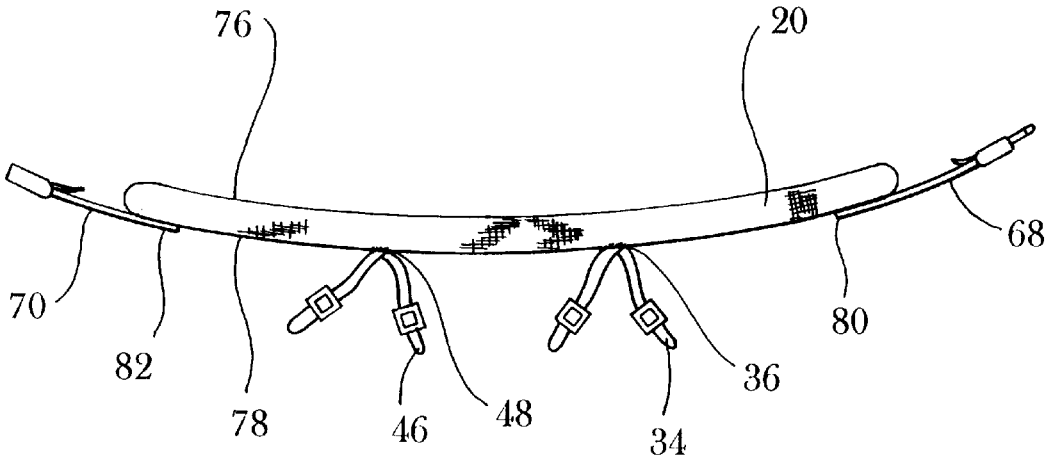
FIG. 3. illustrates a top view of the hip belt member of FIG. 2 in accordance with the present invention.

FIG. 3 illustrates a top view of the hip belt member 20 of the present invention. The hip belt member shown in the embodiment of FIG. 3 is a padded material having an interior surface 76 and an exterior surface 78. A padding or thickness dimension of one and one-half inch has been found to be desirable and comfortable. The waist straps 68, 70 and first and second attachment members 34, 46 are affixed to the exterior surface 78 of the hip belt member so that the interior surface 76 of the hip belt member does not contain any interface surfaces which would uncomfortably contact the user's body. As shown in FIG. 3, the first waist strap is attached to the hip belt member through sew or like attachment 80 and the second waist strap is attached through sew or like attachment 82. The first attachment member 34 is attached to the hip belt member through the first attachment point 36, while the second attachment member 46 is attached through the second attachment point 48 on the exterior surface. For a right-handed golfer, as shown in FIG. 4, the first attachment member 34 is attached to the side of the golf bag near its mouth, while the second attachment member 46 is attached to the top center of the golf bag. Conversely, for a left-handed golfer, the second attachment member 46 can be attached to the side of the golf bag near its mouth, while the first attachment member 34 can be attached to the top center of the golf bag.

FIG. 4 illustrates a person using the hip belt member 20 of the present invention to carry the weight-bearing golf bag 22 with golf clubs therein. The hip belt member is secured around the hips of the user with the belt fastener 28 in the closed position. As shown in FIG. 4, the shoulder strap 30 of the golf bag can be used to further stabilize the golf bag about the user. As can be seen in FIG. 4, the user has easy access to the contents of the golf bag due to the substantially horizontal orientation of the golf bag. Further, because the hip belt member 20 has a belt fastener 28, the hip belt member can be easily removed as the user sees fit. For instance, if the user was preparing to hit a golf shot, the belt fastener 28 could be disconnected and the hip belt member 20 and shoulder strap 30 could be removed to enable the user to freely move unencumbered by either the hip belt member or the shoulder strap.

Also as shown in FIG. 4, the load of the weight-bearing golf bag is now transferred substantially from the user's shoulders and back to the user's hips and legs.

To use the present invention, a user would lift the golf bag and insert an arm into the should strap. The hip belt member 20 would then be positioned about the user's waist and the belt fastener 28 would be latched closed. The adjustable male and female ends along the waist straps could be adjusted to insure a proper fit of the hip belt member about the user's hips. The length of the shoulder strap can be adjusted so that it does not carry a significant amount of the load of the weight-bearing object, but simply acts as a stabilizer, as well as a way to lift the golf bag into position for carrying.

Referring to FIGS. 1 and 4, the hip belt member 20 is attached to the side of the golf bag at the longitudinal center of gravity of the golf bag so that the golf bag will be properly oriented. The hip belt member can be attached to the golf bag by the first and second attachment members (FIG. 2) so that the orientation of the bag is higher at the open end 84 of the golf bag where the clubs are accessible. In this manner, any tendency of the golf clubs to fall out of the golf bag will be reduced.

It will be understood that while FIGS. 2 and 3 illustrate two attachment members, the number of attachment members can be varied to accommodate the particular geometry and characteristics of the weight-bearing object to be carried.

A second embodiment of the present invention is shown in FIGS. 5, 6A–6C, and 7, wherein a shoulder support system is used in conjunction with the hip belt member to carry a weight-bearing object such as a golf bag. The shoulder support system assists in stabilizing the load of the weight-bearing object particularly during instances when the user is moving the weight-bearing object.

Figure 5:
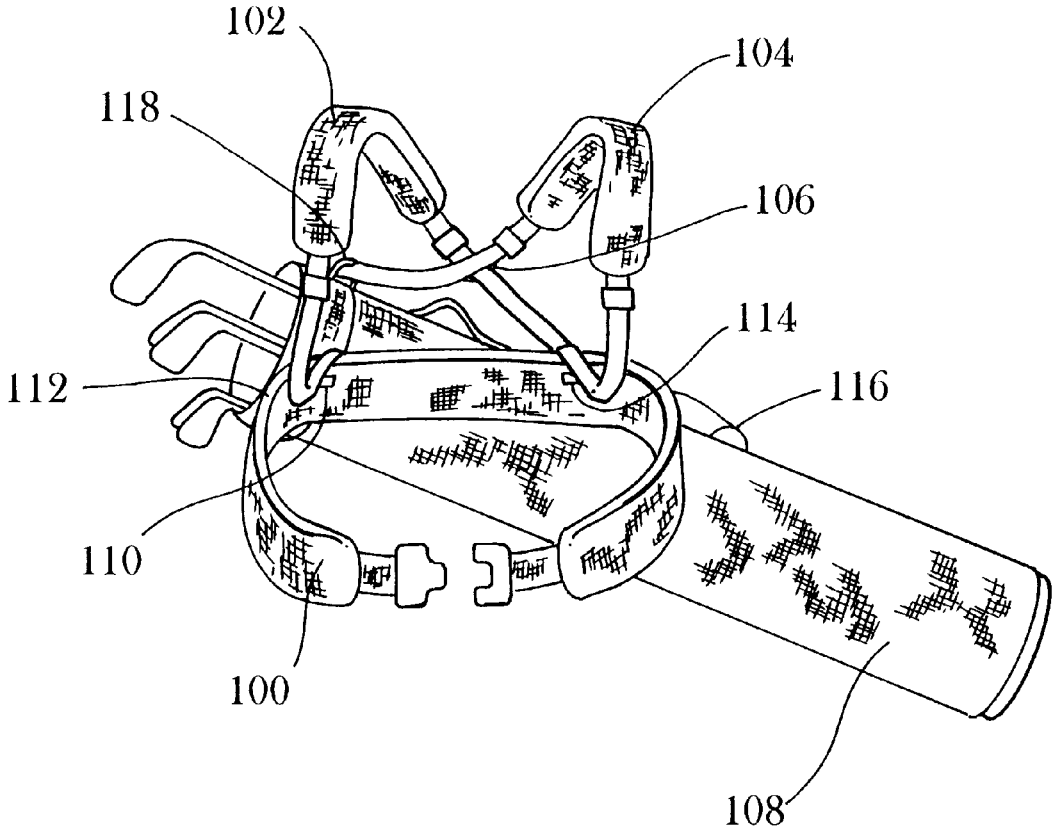
FIG. 5 illustrates an alternative embodiment of the present invention using a right and left shoulder strap in conjunction with the hip belt member of the present invention.

Referring to FIG. 5, the hip belt member 100 of the present invention is shown in conjunction with a right shoulder strap 102 and a left shoulder strap 104 which are overlapped and threaded together. As with the shoulder strap shown in FIGS. 1 and 4, the right and left shoulder straps of the present invention are adjustable so that most of the load of the golf bag can be transferred to and carried by the hip belt member 100. The left and right shoulder straps can be padded where they contact the user's shoulder to improve overall comfort.

In the region where the shoulder straps cross, a slot 106 is provided in one of the shoulder straps through which a portion of the other strap securably passes. The slot keeps the straps from becoming twisted or entangled and makes it easier for the user to insert their arms within the shoulder straps.

In accordance with this embodiment of the present invention, the hip belt member 100 is attached to the weight-bearing object 108 at a first attachment point 110 coupled to the side attachment point 112 near the mouth of the golf bag, and the second attachment point 114 coupled to a central hook 116 of the golf bag. Further, one end of the left shoulder strap 104 is attached to the top hook 118 of the golf bag. The side attachment point 112 of the golf bag supports the bag and prevents the bag from tipping sideways. The side attachment point 112 also provides a point at which the bag can be supported so that the bag is angled upward in its orientation. The side attachment point 112 may be integral to the golf bag, or can be added to the golf bag for attachment to the hip belt member.

By attaching one end of the left shoulder strap 104 to the top hook 118 of the golf bag, upward lift is provided to support the bag from drooping or sagging away from the user. While the top hook attachment point 118 has been shown approximately one quarter of the perimeter of the top portion of the bag away from the side attachment point 112, it is understood that the side attachment point 112 and the top hook attachment point 118 could be located opposite of one another along the periphery of the top portion of the golf bag.

Figure 6A:
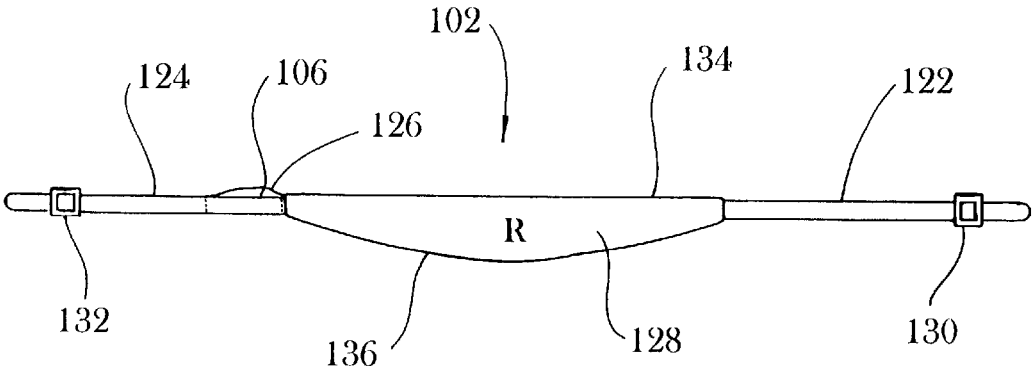
FIG. 6A illustrates a top view of a right shoulder strap of an alternate embodiment of the present invention.
Figure 6B:
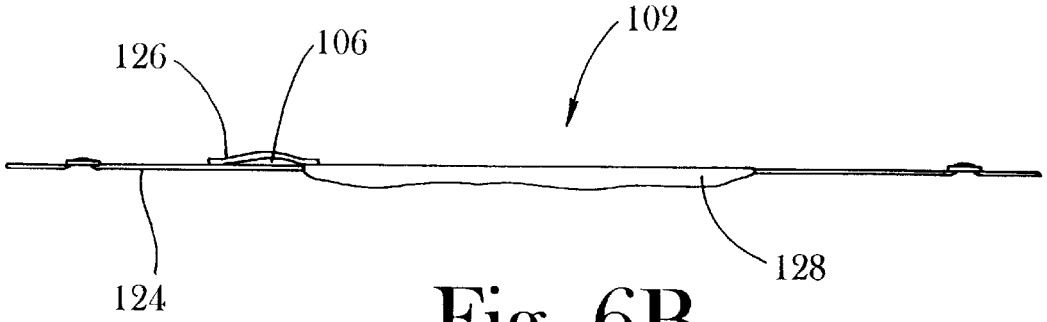
FIG. 6B illustrates a side view of the right shoulder strap of FIG. 6A in accordance with an alternate embodiment of the present invention.
Figure 6C:
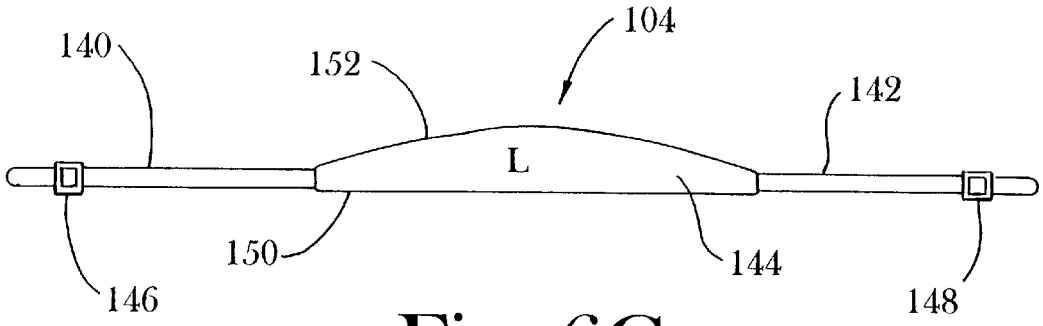
FIG. 6C illustrates a front view of a left shoulder strap of an alternative embodiment of the present invention.

FIGS. 6A–6C illustrate the right and left shoulder straps 102, 104 of the shoulder support system in accordance with the present invention to be used in conjunction with the inventive hip belt member. Referring to FIG. 6A, the right shoulder strap 102 is shown having a first strap 122 and a second strap 124, a slot member 126, a padded central portion 128, and strap adjustable means 130, 132. The first strap 122 is provided for attachment to the hip belt member 100 at the first attachment point 110 as well as the side attachment point 112 of the golf bag. A strap adjustment means 130 is provided on the first strap 122 for adjusting the length of the first strap. The second strap 124 is provided for attachment of the right shoulder strap to the central portion of the bag at the second attachment point 114. The second strap 124 has a strap adjustment means 132 for adjusting the length of the second strap. The right shoulder strap 102 has a padded central portion 128 having a flat side 134 and an arcuate side 136, where the flat side 134 is intended to be worn along the user's shoulder towards the user's neck, while the arcuate side 136 is intended to be worn along the user's shoulder towards the user's arm. The central portion 128 is padded to provide improved comfort, and a ¾" thick padding has been found suitable for this purpose.

A slot member 126 is located on the second strap 124 to receive therein a strap of the left shoulder strap 104, described below. The slot member 126 can be formed by affixing a small portion of additional strap material over the top of the strap to create a slot or channel 106 therein. The width of the slot created should be large enough to accommodate the width of the portion of the left shoulder strap, but small enough to limit the movement of the portion of the left shoulder strap within the slot. FIG. 6B illustrates a side view of the right shoulder strap 102 and shows the slot 106 formed between the slot member 126 and the second strap 124 of the right shoulder strap. While the slot is shown and described with reference to the right shoulder strap, it is understood that the slot could be positioned on either the right or left shoulder strap depending on the particular implementation chosen.

FIG. 6C illustrates the left shoulder strap 104 having a first strap 140, a second strap 142, a padded central portion 144, and a pair of strap adjustment means 146, 148. The first strap 140 is provided for attachment to the golf bag at the top hook 118 of the golf bag. The second strap 142 is provided for attachment to the hip belt member at the second attachment point 114, as well as to the central portion of the bag at the central hook 116. As with the right shoulder strap 102, the left shoulder strap 104 has a first and second strap adjustment means 146, 148 for adjusting respectively the lengths of the first and second straps. The padded central portion 144 has a flat side 150 and an arcuate side 152, the flat side intended to be placed on the user's shoulder towards the neck, while the arcuate side is intended to be placed on the user's shoulder towards the arm. While FIGS. 5 and 6A–6C show a buckle-type or ladder lock buckle adjustment means at 130, 132, 146, and 148, it will be understood that other suitable adjustment means may be used at various locations along the strap for adjusting and securing the length of straps 122, 124, 140 and 142.

Figure 7:
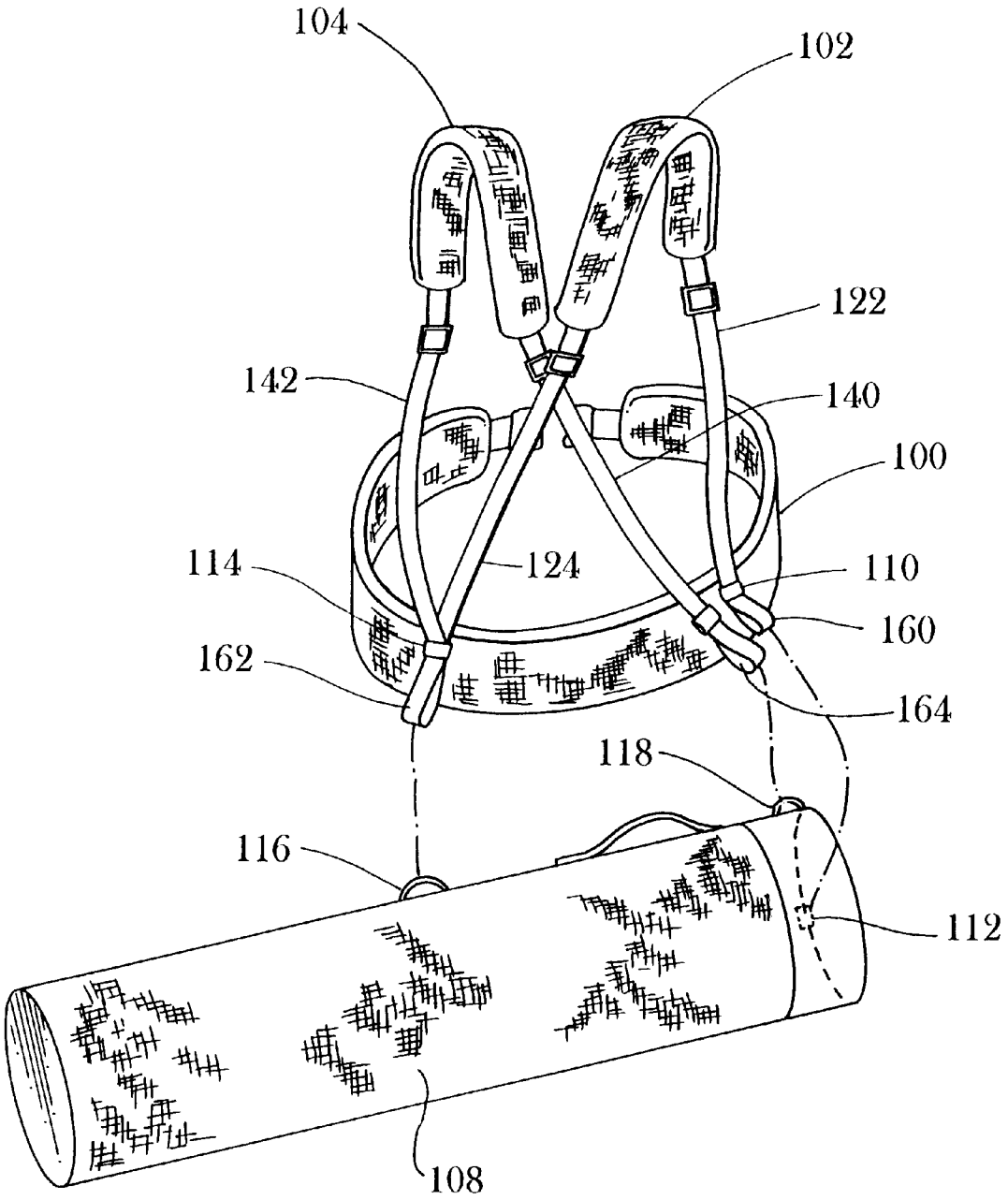
FIG. 7 illustrates a rear view of the alternative embodiment of FIG. 5 showing the attachment points of the inventive system to a golf bag.

FIG. 7 illustrates a rear view of the shoulder strap system and the hip belt member in accordance with the present invention. The right shoulder strap 102 is attached to the hip belt member 100 in two locations. The first strap 122 of the right shoulder strap is attached at the first attachment point 110, while the second strap 124 of the right shoulder strap is attached at the second attachment point 114 of the hip belt member. The first strap forms a first loop 160 at the first attachment point 110 for connection to the side attachment point 112 of the golf bag. The second strap 142 of the right shoulder strap forms a second loop 162 at the second attachment point 114 for attachment to the central hook 116 of the golf bag.

The left shoulder strap 104 is attached to the hip belt member 100 and to the golf bag 108. The first strap 140 of the left shoulder strap forms at its end a third loop 164 for attachment to the top hook 118 of the golf bag. The second strap 142 of the left shoulder strap is attached to the second attachment point 114 of the hip belt member and can also form a second loop 162 for attachment to the central hook 116 of the golf bag. In this unique attachment configuration, this embodiment of the present invention transfers the weight of the golf bag to the user's hips while properly orienting the bag and stabilizing the bag from unwanted movement or rotation.

Using the present invention, the golf bag is carried in an orientation which is substantially horizontal with the open end of the golf bag angled upwards. The golf clubs, golf balls and other accessories are readily accessible to the golfer, and the golfer can easily bend over to pick up golf balls, drink from a water fountain, or tie shoelaces. Further, since the hip belt member is easily detachable, the golfer can remove the hip belt member, and any associated shoulder straps, from his or her body before each golf shot to enjoy a natural golf swing unencumbered by any golf bag carrying apparatus.

While the hip belt member of the present invention and the shoulder support system of the present invention have been shown in conjunction with a golf bag as a weight-bearing object, it is understood that the present invention could be adapted to carry other weight-bearing objects, such as a musical instrument (i.e., a bass drum or set of drums, a xylophone, an upright tuba), tools (i.e., gas powered leaf blowers, portable vacuums, chain saws), cameras and video equipment including their battery packs, military equipment (i.e., guns, radios), or small children in a suitable infant seat carrier, without departing from the scope of the present invention.

While the invention has been particularly shown and described with reference to a preferred embodiment thereof, it will be understood by those skilled in the art that various other changes in the form and details may be made without departing from the spirit and scope of the invention.

I claim:

1. An apparatus for carrying a load behind a user, said load having first and second attachment points, said first and second attachment points being spaced apart to assist in stabilizing said load behind the user as said load is being carried, comprising:

a hip belt member having a central portion, a first hip portion, and a second hip portion;

a first waist strap coupled to said first hip portion;

a second waist strap coupled to said second hip portion;

a belt fastener for connecting said first waist strap to said second waist strap in front of said user to enable said hip belt member to be selectively mounted to encircle the user's hips with said central portion behind the user;

first and second attachment members on said hip belt member to enable said hip belt member to be attached to said load at said first and second attachment points of said load;

a first shoulder strap having a central portion, a first strap portion attached to said first attachment member and a second strap portion attached to said second attachment member; and a second shoulder strap having a central portion, a first strap portion for attachment to said load at a point along the top of said load, and a second strap portion attached to said second attachment member.

2. The apparatus as defined in claim 1, wherein said hip belt member is padded along the central portion.

3. The apparatus as defined in claim 1, wherein said first waist strap is adjustable in length.

4. The apparatus as defined in claim 1, wherein said belt fastener is a bayonet-type snap clasp having a male end and a female end.

5. The apparatus as defined in claim 1, wherein the first attachment member has an adjustable fastener; and the second attachment member has an adjustable fastener.

6. The apparatus as defined in claim 1, wherein said load is a golf bag.

7. The apparatus of claim 1 wherein said first and second attachment members are spaced apart a distance wherein a center of gravity of said load is between said first and second attachment members when said load is attached thereto.

8. An apparatus for carrying a load behind a user's back, comprising:

a hip belt member for supporting said load, said hip belt member having a first end and a second end;

a belt fastener for connecting said first end to said second end in front of the user to mount the hip belt member about the user's waist; and first and second attachment members on said hip belt member to enable said hip belt member to be attached to said load at two spaced apart locations on said load;

a first shoulder strap having a central portion, a first strap portion attached to said first attachment member and a second strap portion attached to said second attachment member; and a second shoulder strap having a central portion, a first strap portion for attachment to said load at a point along the top of said load, and a second strap portion attached to said second attachment member.

9. The apparatus as defined in claim 8, wherein said load is a golf bag.

10. The apparatus of claim 8 wherein said strap is attached at another end to one of said hip portions of said hip belt.

11. A system for carrying a load having first and second spaced apart attachment points, comprising:

a hip belt member for supporting said load behind a user's back, said hip belt member having a first end and a second end;

a belt fastener for connecting said first end to said second end in front of the user to mount the hip belt about a user's waist;

first and second attachment members coupled to said hip belt member to enable said hip belt member to be attached to said load at said attachment points to assist in stabilizing the load;

a first shoulder strap having a central portion, a first strap portion attached to said first attachment member and a second strap portion attached to said second attachment member; and a second shoulder strap having a central portion, a first strap portion for attachment to said load at a point along the top of said load, and a second strap portion attached to said second attachment member.

12. The system of claim 11, wherein said load is a golf bag.

13. The system of claim 11, wherein said first shoulder strap has a slot member positioned along said first strap for defining a slot, said slot adapted to receive said first strap of said second shoulder strap.

14. The system of claim 11 wherein said first and second attachment members are spaced apart a distance wherein a center of gravity of said load is between said first and second attachment members when said load is attached thereto.

* * * * *